US005823048A

United States Patent [19]

Saupe

[11] Patent Number: 5,823,048

[45] Date of Patent: Oct. 20, 1998

[54] STARTER FOR AN ENGINE

[75] Inventor: Thomas Saupe, Herzogenaurach, Germany

[73] Assignee: FEV Motorentechnik GmbH & Co. KG, Aachen, Germany

[21] Appl. No.: 687,477

[22] PCT Filed: Nov. 30, 1995

[86] PCT No.: PCT/EP95/04709

§ 371 Date: Aug. 5, 1996

§ 102(e) Date: Aug. 5, 1996

[87] PCT Pub. No.: WO96/18034

PCT Pub. Date: Jun. 13, 1996

[30] Foreign Application Priority Data

Dec. 8, 1994 [DE] Germany ..... 44 43 674.2

[51] Int. Cl.[6] ..... F02N 15/04

[52] U.S. Cl. ..... 74/8; 74/7 C; 192/42

[58] Field of Search ..... 74/8, 354, 7 C; 192/42, 138, 139

[56] References Cited

U.S. PATENT DOCUMENTS

| | | | |
|---|---|---|---|
| 1,498,317 | 6/1924 | Brockway | 74/8 |
| 1,502,671 | 7/1924 | Hillmer et al. . | |
| 1,600,460 | 9/1926 | Eichenberg | 74/8 |
| 1,633,862 | 6/1927 | Kelly et al. | 74/8 |
| 2,151,042 | 3/1939 | Mcgrath | 74/8 |
| 2,823,546 | 2/1958 | Barrett | 74/8 |
| 2,905,001 | 9/1959 | Courtney et al. | 74/8 |
| 3,820,406 | 6/1974 | Toulier | 192/42 |

FOREIGN PATENT DOCUMENTS

| | | |
|---|---|---|
| 673329 | 1/1930 | France . |
| 722553 | 3/1932 | France . |
| 325109 | 9/1920 | Germany . |
| 390160 | 2/1924 | Germany . |
| 396639 | 6/1924 | Germany . |
| 490441 | 1/1930 | Germany . |
| 4204124 | 8/1992 | Germany . |
| 2077858 | 6/1981 | United Kingdom . |

*Primary Examiner*—Charles A. Marmor
*Assistant Examiner*—Ankur Parekh
*Attorney, Agent, or Firm*—Spencer & Frank

[57] ABSTRACT

An engine starter includes an electric driving motor having a drive shaft; a transmission pinion coupled to the drive shaft; a starter pinion meshing with the transmission pinion; and a swiveling device mounted on the drive shaft for pivotal motion thereabout. The starter pinion is rotatably supported in the swiveling device. A friction clutch torque-transmittingly couples the drive shaft to the swiveling device for causing the swiveling device to pivot about the shaft for placing the starter pinion in a working position when the shaft is rotated in a driving direction. The engine starter further has an overrunning device for transmitting a driving torque between the drive shaft and the transmission pinion solely when the drive shaft rotates at least at the same speed as the transmission pinion.

6 Claims, 1 Drawing Sheet

STARTER FOR AN ENGINE

BACKGROUND OF THE INVENTION

The currently used starters for engines, in particular piston-type internal combustion engines, include an electric driving motor having an axially displaceable starter pinion, which can be made to engage in the starting gear toothing through axial displacement with the aid of an actuating means, for example an electric lifting magnet. Such a starter is, for example, described in DE-A-42 04 124.

Starters of an older design have a transmission pinion that is fixed immovably to the drive shaft of the electric driving motor and meshes continuously with the starter pinion, wherein the starter pinion can be made to engage in the toothing for the engine starting gear by swiveling it around the axis of the drive shaft. Such starters are known, for example, from DE-PS 325 109; 390 160; 369 639 and 490 441.

These designs are relatively complex because they always require an additional actuation means that must be activated to make the starter pinion mesh with the toothing for the starting gear.

SUMMARY OF THE INVENTION

It is the object of the invention to create a starter with a simplified structural design and, accordingly, fewer structural components.

The invention solves this with a starter of the above-described type, having an electric driving motor, the drive shaft of which is operatively connected with a transmission pinion via an overrunning clutch that locks in the rotational drive direction. The transmission pinion itself meshes with a starter pinion, mounted in such a way that it rotates on a swiveling device, which is installed such that it swivels around the drive shaft axis and is operatively connected with the drive shaft via a friction clutch. Such a starter has the advantage that when the electric driving motor is activated, it swivels the swiveling device with the aid of the friction clutch, thereby causing the starter pinion to mesh with the toothing for the starting gear and to maintain this contact as long as the driving motor is operational. As soon as the engine is started, with the engine speed as a rule being higher even when idling than the speed of the electric driving motor for the starter by taking into account the gear ratio between starter gear and starter pinion. As a result, thereby the electric driving motor for the starter would be forced to also rotate with increased speed. The series-connected overrunning device, however, has the effect of allowing a free running of the starter pinion and transmission pinion, depending on the speed of the starting gear, without the transmission pinion exerting a forced torque on the rotor of the electric driving motor. As long as the electric driving motor for the starter is switched on, the starter pinion continues to mesh with the starting gear via the friction clutch that acts upon the swiveling device. As soon as the power supply for the electric driving motor is turned off, the swiveling device can be turned with the aid of corresponding restoring means, for example a spring or even the force of gravity, thus disengaging the starter pinion. Additional actuators for actuating the swiveling device are therefore not needed.

In order to further simplify the design and reduce the structural components, it is possible to dispense with the restoring means if in a further improvement of the invention, the electric driving motor is designed such that it can reverse its rotational direction. This arrangement has the advantage that by way of a respective electric switchgear, the electric driving motor briefly reverses the rotational direction at the exact moment when the starter switch is turned to the zero position and the electric driving motor is without power, so that the swiveling device is turned back to the rest position with the aid of the friction clutch that acts upon the swiveling device. The swiveling device can then be kept in this rest position by the force of gravity, if necessary with the additional effect of a lightweight retaining spring or a spring catch. Expediently the swiveling device effectively as a swiveling arm, so that the weight of the rotatably mounted starter pinion at the free end of the swiveling arm is sufficient as the retaining force.

Another embodiment of the invention provides that the transmission pinion and the overrunning device are arranged jointly on the drive shaft.

Yet another advantageous embodiment of the invention provides that the swiveling device is arranged on the drive shaft such that it can be swiveled. This results in a further reduction of the structural components as well as the assembly work.

A further advantageous embodiment of the invention provides that the friction clutch is formed by at least one spring-loaded clutch component, which is frictionally engaged at least with the swiveling arm. The arrangement here can be such that the clutch component, for example, is connected with the drive shaft to rotate therewith as a unit and is frictionally coupled to the swiveling arm. The reverse design is also possible. For the simplest embodiment, for example when using one or more disk spring elements that can be prestressed, it is also possible to have a corresponding friction-lock effect between the drive shaft as well as between the swiveling device. Design and assembly are further simplified by such an embodiment.

In yet another advantageous embodiment of the invention, it is provided that the swiveling device has stops for limiting the swivel movement between a rest position and an operating position. In addition to locking the swiveling device in the rest position, mounting a stop for limiting the swiveling movement in the operating position has the advantage of resulting in exactly definable pressure forces between the starter pinion teeth and the starter gear toothing.

BRIEF DESCRIPTION OF THE DRAWINGS

The invention is explained in more detail with the aid of diagrammatic drawings of an exemplary embodiment. Shown are in.

DESCRIPTION OF THE PREFERRED EMBODIMENT

Figure 1:
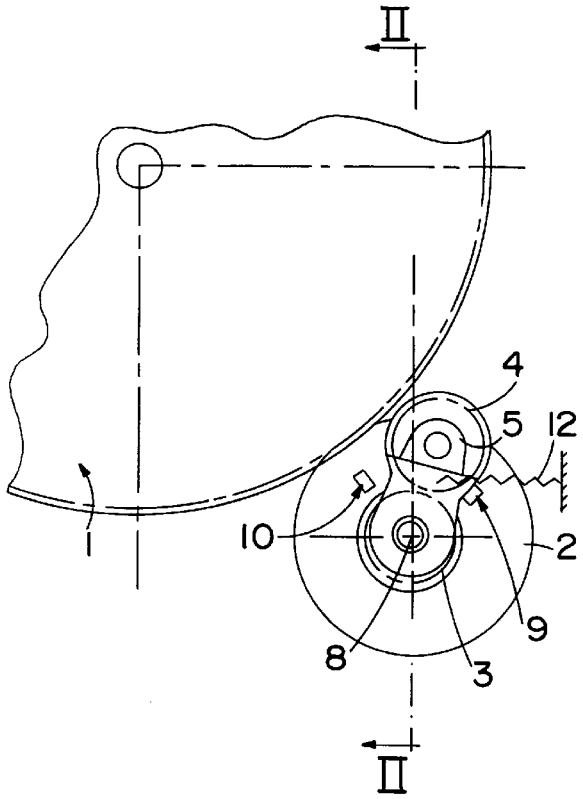
FIG. 1 A frontal view of the device of the invention in the rest position.

FIG. 1 shows the starting gear 1 for a piston-type internal combustion engine, which serves simultaneously as a flywheel and is equipped with toothing on the outside. An electric driving motor 2 is mounted parallel to the axis of starting gear 1. The drive shaft of the driving motor is connected to a transmission pinion 3, which meshes with a starter pinion 4. The starter pinion 4 is arranged such that it rotates freely at the free end of a swiveling device 5 that is designed as swiveling arm, wherein the swiveling device 5 itself is arranged such that it swivels on drive shaft 8 of driving motor 2. The swiveling movement of swiveling device 5 is limited in both directions by stops 9 and 10 on driving motor 2.

Figure 2:
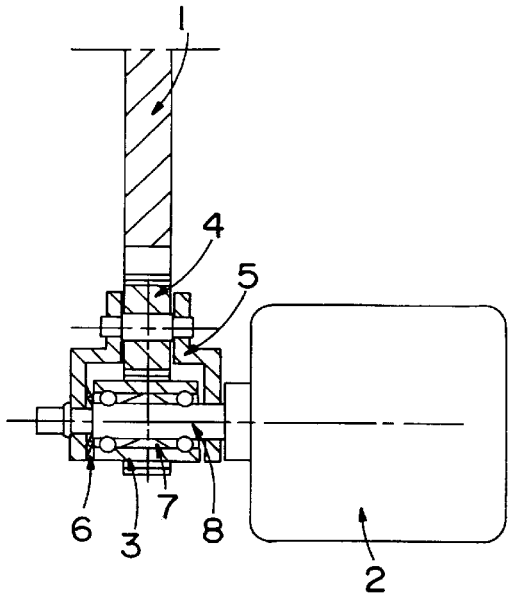
FIG. 2 A partial section through the arrangement, along line II—II in FIG. 1.

As can be seen in FIG. 2, the arm-shaped swiveling device 5 has a "clamshell-type" design and is arranged directly on drive shaft 8 of driving motor 2. At least one spring-loaded clutch component, functioning as a friction clutch 6, is installed between drive shaft 8 and swiveling device 5. For the exemplary embodiment shown here, the friction clutch consists of a disk-shaped spring, which is supported at its inside edge on a collar of drive shaft 8 and at its outside edge on a counter-surface of swiveling device 5. The transferable friction force is defined by a suitable prestressing of the disk-shaped spring. As soon as drive shaft 8 turns upon the start-up of driving motor 2, swiveling device 5 is moved in a rotational direction by way of the friction forces of friction clutch 6 until it strikes one of the stops 9 or 10. As long as the driving motor 2 is activated, the swiveling device 5 is held against the respective stop 9 or 10, depending on the rotational direction.

Furthermore, transmission pinion 3 is arranged rotatably on and relative to the drive shaft 8, and an overrunning (free wheeling) device 7 is provided, which is designed such that it transmits a torque for the starter operation in the rotational drive direction, that is, upon activation of the starter, and that it runs freely if the drive shaft rotates in the opposite direction. This free run also occurs if the drive shaft 8 rotates slower than the transmission pinion 3 or if drive shaft 8 is at a standstill.

Figure 3:
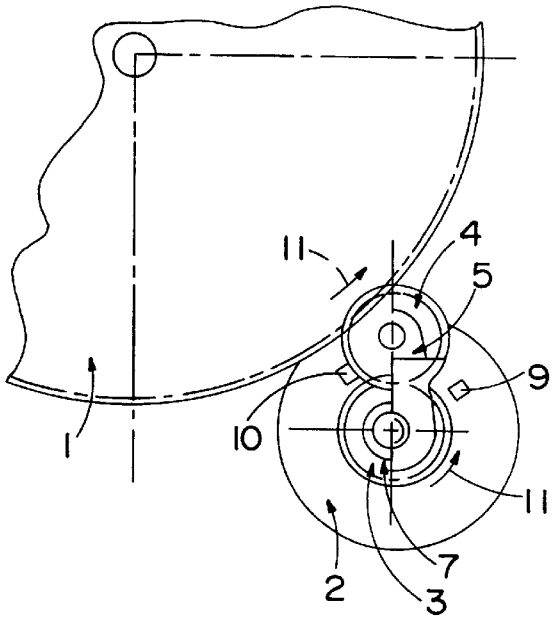
FIG. 3 A frontal view of the arrangement according to FIG. 1, in the operating position.

While FIG. 1 displays the arrangement in the rest position, FIG. 3 shows the arrangement in operational position, with swiveling device 5 partially broken off. The diagrammatic display of overrunning device 7 shows that for the rotational directions of drive shaft 8 and starting gear 1, which are given through arrows 11, it is also possible to obtain a free run while the engine is operational and no torque is transmitted from transmission pinion 3 to drive shaft 8.

In the exemplary embodiment shown here, if the starter is to be turned off, then the rotational direction of driving motor 2 is reversed quickly by a simple electrical switch, which is not shown here in detail, so that with the aid of friction clutch 6, swiveling device 5 is swiveled back from the operational position shown in FIG. 3, that is from stop 10 against stop 9 and to the rest position. If the driving motor 2 is associated with starting gear 1 in the manner shown in FIG. 3, the gravitational force acting upon the swiveling device 5 is sufficient to keep this device in the rest position at stop 9, if such a starter arrangement is, for example, used with a stationary motor. The holding in place in the rest position can also be ensured with a suitably arranged light-weight retaining spring 12, as shown diagrammatically in FIG. 1, or by a corresponding snap catch. Return spring 12 here simply functions to maintain the swiveling device 5 in the rest position since the required torque for swiveling from the operational position (FIG. 3) to the rest position (FIG. 1) is effected in the exemplary embodiment shown by a reversal of the rotational direction of driving motor 2, so that the friction coupling is not stressed additionally to a large degree by this spring.

I claim:

1. An engine starter comprising (a) an electric driving motor having a drive shaft;

(b) a transmission pinion coupled to said drive shaft;

(c) a starter pinion meshing with said transmission pinion;

(d) a swiveling device mounted on said drive shaft for pivotal motion thereabout; said starter pinion being rotatably supported in said swiveling device;

(e) a friction clutch torque-transmittingly coupling said drive shaft to said swiveling device for causing said swiveling device to pivot about said shaft for placing said starter pinion in a working position when said shaft is rotated in a driving direction; and (f) an overrunning device for transmitting a driving torque between said drive shaft and said transmission pinion solely when said drive shaft rotates at least at the same speed as said transmission pinion.

2. The engine starter as defined in claim 1, wherein said transmission pinion and said overrunning device are mounted on said drive shaft.

3. The engine starter as defined in claim 1, wherein said friction clutch comprises a spring-biased coupling element frictionally connected to said swiveling device.

4. The engine starter as defined in claim 1, wherein said electric driving motor can reverse its rotational direction.

5. The engine starter as defined in claim 1, further comprising stops for limiting said pivotal motion of said swiveling device between a position of rest and said working position.

6. The engine starter as defined in claim 5, further comprising restoring means for returning and holding said swivel device in said position of rest.

* * * * *